US008505919B2

(12) United States Patent
Jones

(10) Patent No.: US 8,505,919 B2
(45) Date of Patent: Aug. 13, 2013

(54) ROTARY CARD SHUFFLING MACHINE

(75) Inventor: Mark H. Jones, Paradise, CA (US)

(73) Assignee: Mark H. Jones, Minden, NV (US)

( * ) Notice: Subject to any disclaimer, the term of this patent is extended or adjusted under 35 U.S.C. 154(b) by 9 days.

(21) Appl. No.: 13/280,691

(22) Filed: Oct. 25, 2011

(65) Prior Publication Data

US 2012/0056373 A1 Mar. 8, 2012

Related U.S. Application Data

(63) Continuation-in-part of application No. 12/912,276, filed on Oct. 26, 2010.

(60) Provisional application No. 61/255,128, filed on Oct. 27, 2009, provisional application No. 61/408,270, filed on Oct. 29, 2010.

(51) Int. Cl.
*A63F 1/00* (2006.01)

(52) U.S. Cl.
USPC ..... 273/292; 273/274

(58) Field of Classification Search
USPC ..... 273/149 R, 292, 274
See application file for complete search history.

(56) References Cited

U.S. PATENT DOCUMENTS

| | | | | |
|---|---|---|---|---|
| 3,841,637 | A | 10/1974 | Piazza et al. | |
| 3,936,054 | A | 2/1976 | Garcia | |
| 5,918,884 | A | 7/1999 | DiMuro | |
| 6,692,003 | B2 | 2/2004 | Potter et al. | |
| 7,669,853 | B2 | 3/2010 | Jones | |
| 7,677,571 | B2 * | 3/2010 | Adams, III | 273/274 |
| 2008/0073842 | A1 * | 3/2008 | Jones | 273/149 R |

* cited by examiner

*Primary Examiner* — Michael Dennis
(74) *Attorney, Agent, or Firm* — Dickinson Wright PLLC

(57) ABSTRACT

A rotary card shuffling and selection machine for use in playing a game of chance includes a wheel supported in a generally vertical plane for rotation about a horizontal rotary axis (A). The wheel is provided with a plurality of card slots arranged concentrically about the rotary axis (A). Each card slot holds a card bearing indicia suitable to decide the game of chance. The cards are held in each card slot via friction elements. First and second flappers cooperate with one another to progressively slow the wheel after it is manually spun by an operator. The cards may be placed in opaque folders in the slots to hide the indicia while the wheel is spinning. Alternatively, the indicia may be located on the card so that it is hidden inside the slot when the wheel is spinning.

20 Claims, 6 Drawing Sheets

FIG. 4
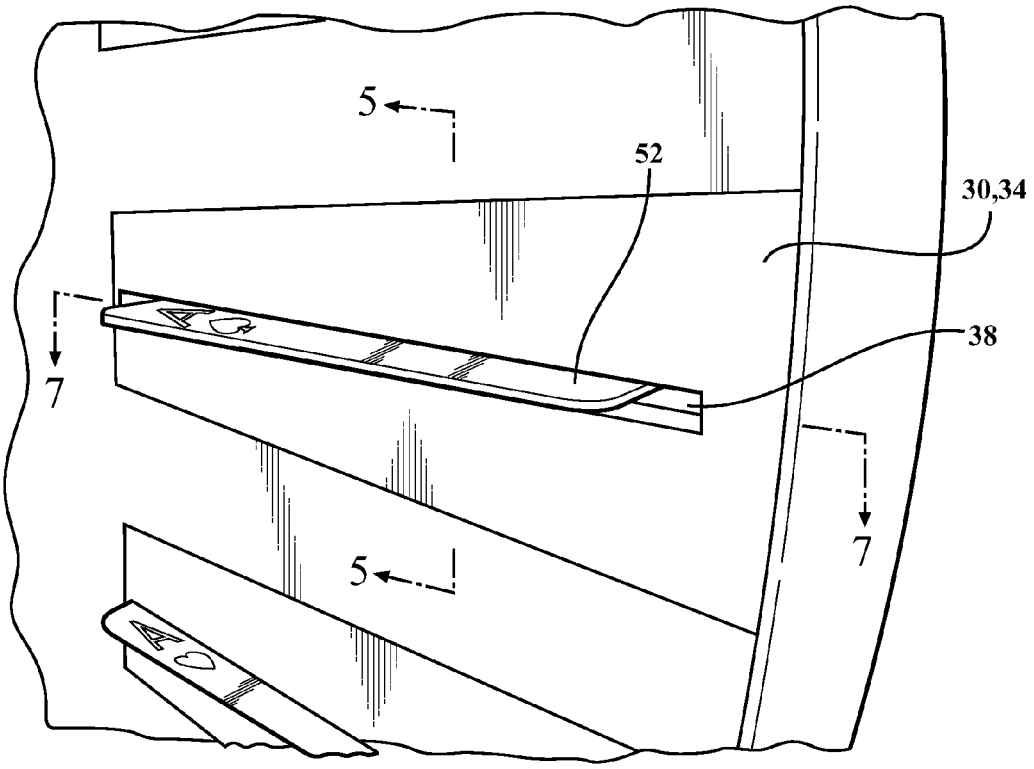
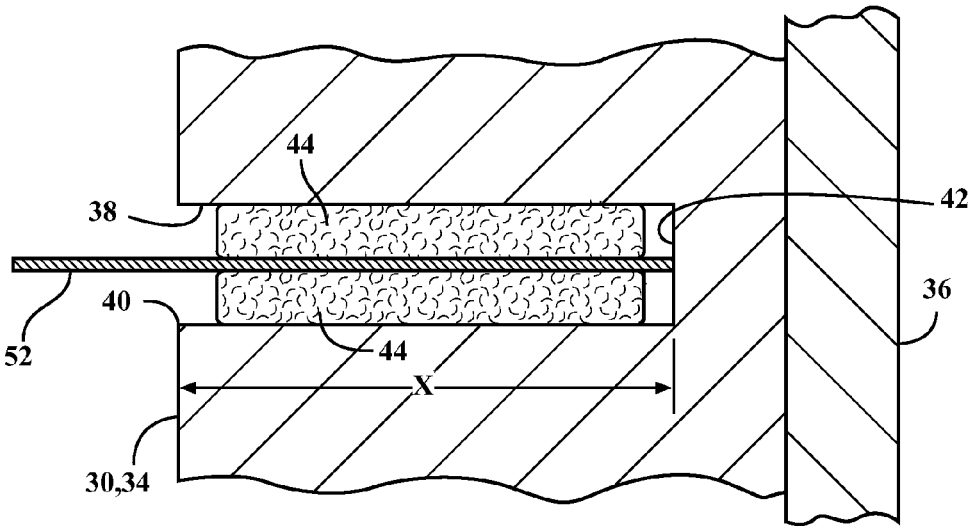
FIG. 5

ROTARY CARD SHUFFLING MACHINE

CROSS REFERENCE TO RELATED APPLICATIONS

This application is a Continuation-In-Part of U.S. patent application Ser. No. 12/912,276 filed Oct. 26, 2010, which claims priority to Provisional Patent Application No. 61/255,128 filed Oct. 27, 2009, and this application also claims priority to Provisional Patent Application No. 61/408,270 filed Oct. 29, 2010, the entire disclosures of which are hereby incorporated by reference and relied upon.

BACKGROUND OF THE INVENTION

1. Field of the Invention

This invention relates generally to a card shuffling and selection machine for a game of chance, and more particularly toward a rotary card shuffling and selection machine supported for rotation in a generally vertical plane about a generally horizontal rotary axis.

2. Related Art

The games of Money Wheel and Big Six are well established casino games including a "prize-wheel" type of random point generating device in the form of a large vertical rotating wheel. The playing wheel is imprinted with a plurality of fixed symbols along its circumference. By use of the term "fixed" here to refer to the symbols, it is meant that the symbols are imprinted on the wheel at the factory and cannot be rearranged or their relative positions manipulated in any reasonable way. A nearby player betting surface presents a plurality of wagering areas corresponding to the fixed symbols on the playing wheel. Each round of the game starts with the players placing wagers on the wagering areas. Once all of the wagers are placed, a dealer manually spins the playing wheel, and a winning symbol is determined via a fixed pointer once the playing wheel comes to a stop. Wagers previously placed on the wagering area associated with the winning symbol are deemed "winners" and paid according to a predetermined pay-out.

Gaming laws vary greatly from one jurisdiction to the next throughout the United States. Consequently, many jurisdictions significantly restrict the playing of dice and wheel casino games. Wheel games are generally restricted in those jurisdictions if they have a moving random number or result generation wheel with indicia being fixed in a permanent manner to the wheel itself. Again, use of the term "fixed" here refers to the indicia being imprinted on the wheel at the factory and not realistically capable of being rearranged by a casino. It does not matter whether the wheel operates in a vertical fashion, like the above-described prize wheel, or in a horizontal position, like a roulette wheel. The key is that the indicia for that apparatus must always be in the same position of the wheel for the game to be considered restricted. For example, the 0 and 00 are always fixed to the same spot on a single or double roulette wheel, and the 40 to 1 indicia is always fixed to the same location on a "Money Wheel."

In addition to being restricted in many jurisdictions, fixed indicia wheel games present two additional problems. The first problem is that wheels may be rigged, or "gaffed", to generate a preferred outcome. The second problem is that any misbalance in the wheel will favor one outcome over another. New devices have been created that allow cheaters to determine whether a wheel is out of balance, and if so, what outcome has an increased expectation of appearing. Cheaters then use this information to their advantages when placing wagers.

U.S. Pat. No. 7,669,853, issued to Mark H. Jones (hereinafter referred to as "Jones '853"), shows a horizontally mounted wheel for use in wheel games, e.g. Roulette. Rather than having fixed indicia on the wheel, which is not only restricted in many jurisdictions but also easy for cheaters to crack, the wheel of the Jones '853 patent uses a variable indicia system in the form of removable and re-orderable playing cards. The playing cards are disposed around the circumference of the playing wheel, and a flapper is used to determine the winning card. The playing cards are periodically removed from the shuffler machine and rearranged between rounds by the casino, thus varying the positions of the indicia. The wheel of the Jones '853 patent is designed to randomly generate a winning card, or cards, from a mix of cards, and as such may be used for several different games, including dice games like craps. The key to its overwhelming legal acceptance, even in jurisdictions where other types of wheel games are prohibited, has been that the cards are periodically removed, shuffled, and returned to the machine based on the casino's policies and procedures. In other words, the cards are not fixed forever in a specified slot, but rather periodically randomly relocated into different slots between games. The variable position of the indicium negates any advantage a cheater might gain from knowledge of a biased wheel. The wheel of the Jones '853 patent is not operable in a vertical position, however, because the cards would too easily fall out of the apparatus during the spinning (shuffling) process, and because no provision is made to hide the card indicia while the wheel is spinning for casinos that believe such action is necessary.

U.S. Pat. No. 3,841,637 to Piazza et al. discloses a card wheel type device in which cards may be placed in a horizontally rotatable platter via respective card receptacles and support members fitted each with a clamp section. Like the Jones '853 wheel, the Piazza device is also particularly ill-suited for operation in the vertical "prize wheel" dimension because its cards would not be properly retained in the slots when the wheel is rotated. Any cards slipping loose from the open-end slots in Piazza would create a catastrophic event bringing game play to a halt and jeopardizing the trust and integrity players must possess toward the operators of a game of chance.

There is therefore a need in the art for an improved "prize wheel" type device which can accommodate the variable indicium features of the Jones '853 invention. Such a vertically oriented wheel must reliably hold cards in respective card slots without risk of loss, yet permit convenient removal and replacement of such cards at the end of each spin in order to render a game decision. It would also be beneficial if provisions were made to hide the card indicia while the wheel is spinning for certain casino preferences.

SUMMARY OF THE INVENTION

This invention relates to a rotary card shuffling and selection machine. The machine includes a support structure and an axle that extends generally perpendicularly from the support structure for establishing a generally horizontal rotary axis. A wheel is supported on the axle for rotation about the rotary axis. The wheel includes a hub section defined within an outer rim. The hub section has a front face. The hub section includes a plurality of card slots. The total number of the plurality of card slots comprises a predetermined number. Each of the card slots extends axially from an open end through the front face of the hub to a bottom, and defines a slot depth. The card slots are disposed in equal circumferential increments about the rotary axis. A friction element is disposed in each cart slot. The wheel includes a plurality of dividers, with the total number of dividers equal to the predetermined number of card slots. The dividers are disposed in equal circumferential increments about the rotary axis. The plurality of dividers are arranged in generally equal radial spacing from the rotary axis. A first flapper is supported by the support structure adjacent the outer rim of the wheel. The first flapper comprises a first resilient paddle extending into an interference position relative to the dividers so that as the wheel is spun about the rotary axis the plurality of dividers sequentially strike and displace the first resilient paddle thereby progressively slowing the spinning wheel to a stop. A plurality of cards are provided, the total number of which is equal to the predetermined number of card slots. One card is removably disposed in each card slot so that all of the card slots are filled with cards. Each card bears an indicia suitable to decide the outcome of a game of chance. The cards interact with the respective friction element in each slot to help retain the card in the slot while the wheel is spinning.

The subject rotary card shuffling and selection machine provides a new and improved type of prize wheel device suitable for play of games such as Money Wheel and Big Six, as well as many other and new games of chance. One advantage of the present machine is that the cards can be periodically rearranged and placed in the respective card slots in a new order thereby making it very difficult for players to predict an outcome using the skill of wheel tracking or knowledge of a mechanical bias. Furthermore, the subject machine substantially impedes the possibility for improper collusion between the dealer and players. The subject machine neatly retains cards in the respective card slots as the wheel is rotated without allowing the cards to become dislodged but yet the cards remain easily removed for a game decision and then returned to card slot for continued play.

BRIEF DESCRIPTION OF THE DRAWINGS

These and other features and advantages of the present invention will become more readily appreciated when considered in connection with the following detailed description and appended drawings, wherein:

FIG. 4 is an enlarged view of the area circumscribed at 4 in FIG. 2 showing a card disposed in a card slot of the present machine;

FIG. 5 is a cross-sectional view taken laterally through a card slot generally along lines 5-5 in FIG. 4;

DETAILED DESCRIPTION OF THE PREFERRED EMBODIMENT

Figure 1:
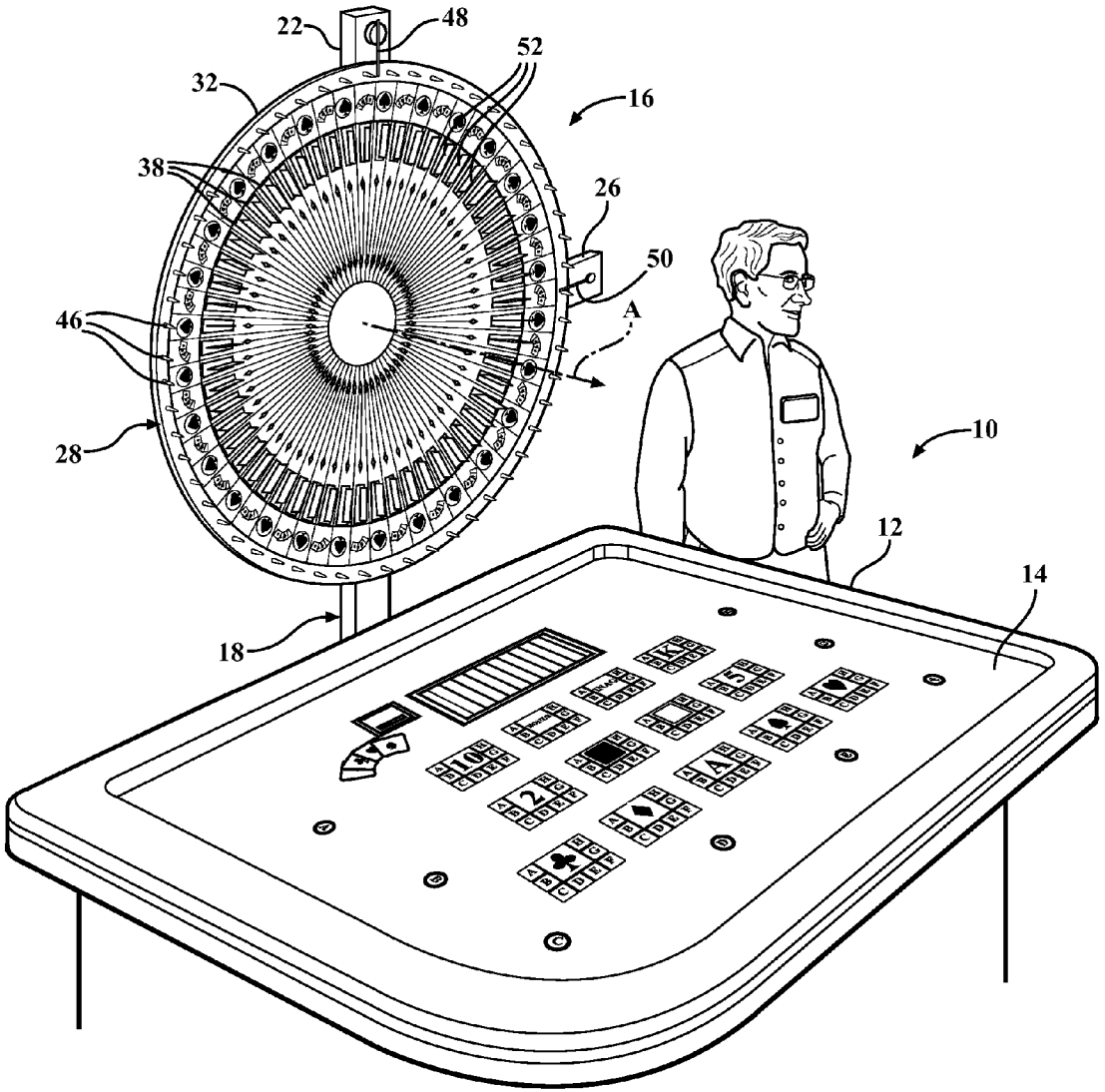
FIG. 1 is a perspective view of an exemplary casino-type game of chance played with a rotary shuffling machine according to the present invention.

Referring to the Figures, wherein like numerals indicate like or corresponding parts throughout the several views, a simplified depiction of a live game of chance is generally shown at 10 in FIG. 1. The game of chance 10 is intended to represent any type of game that may be played according to the teachings of the present invention. Such games may include, but are by no means limited to, the games of Money Wheel and Big Six. In addition, the game of chance 10 may include future developed games suitable for play using the teachings of this invention. Although the illustration in FIG. 1 shows a physical table 12 having a horizontal playing surface 14 around which players (not shown) congregate to place wagers, it will be understood that electronic implementations of the game of chance 10 are possible without departing from the spirit and scope of this invention. In particular, in electronic versions, the playing surface 14 may be displayed via a monitor or projector (not shown) on one or more terminals in the same or in geographically disperse locations.

Figure 2:
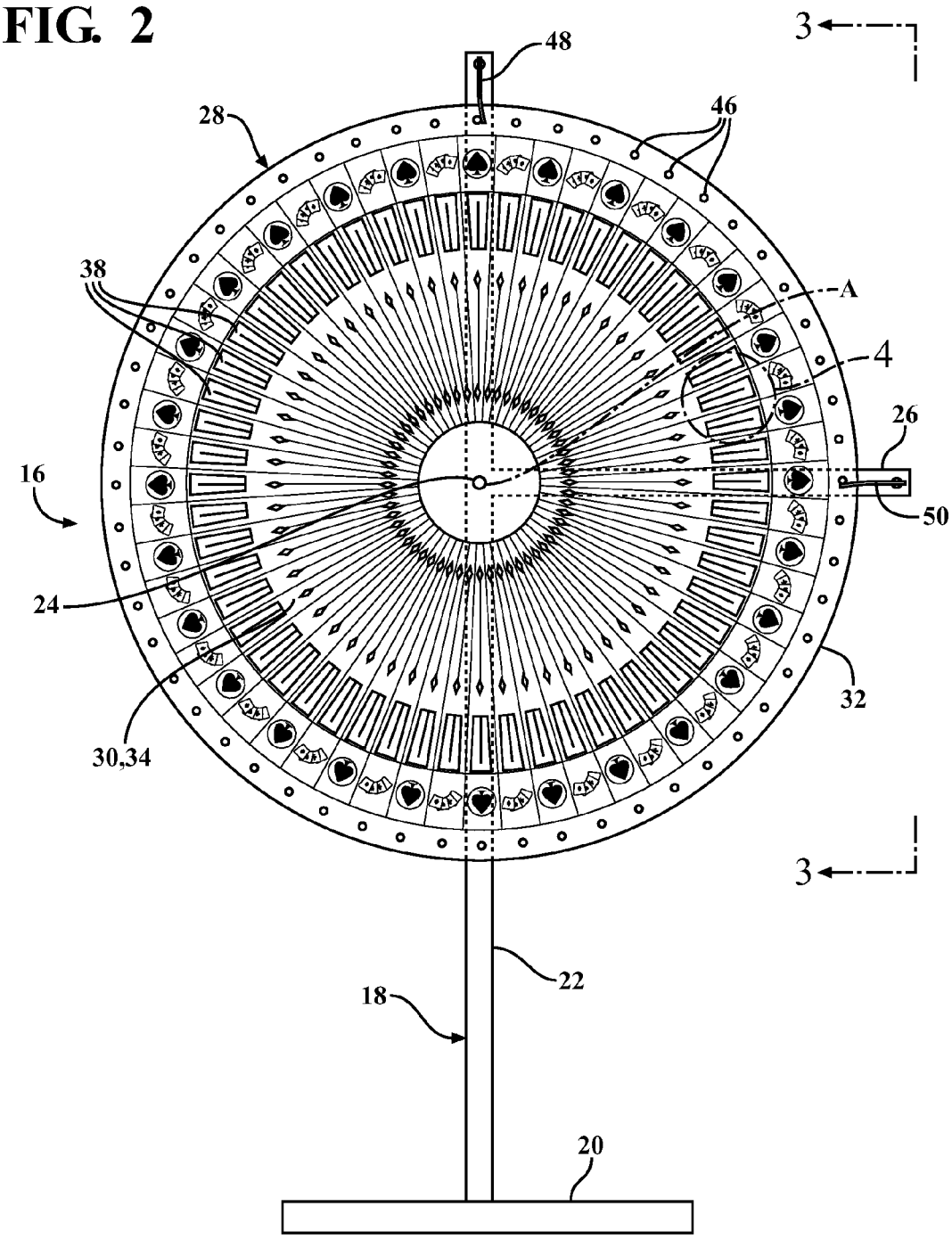
FIG. 2 is a front elevation of the subject card shuffling machine in one exemplary form.
Figure 3:
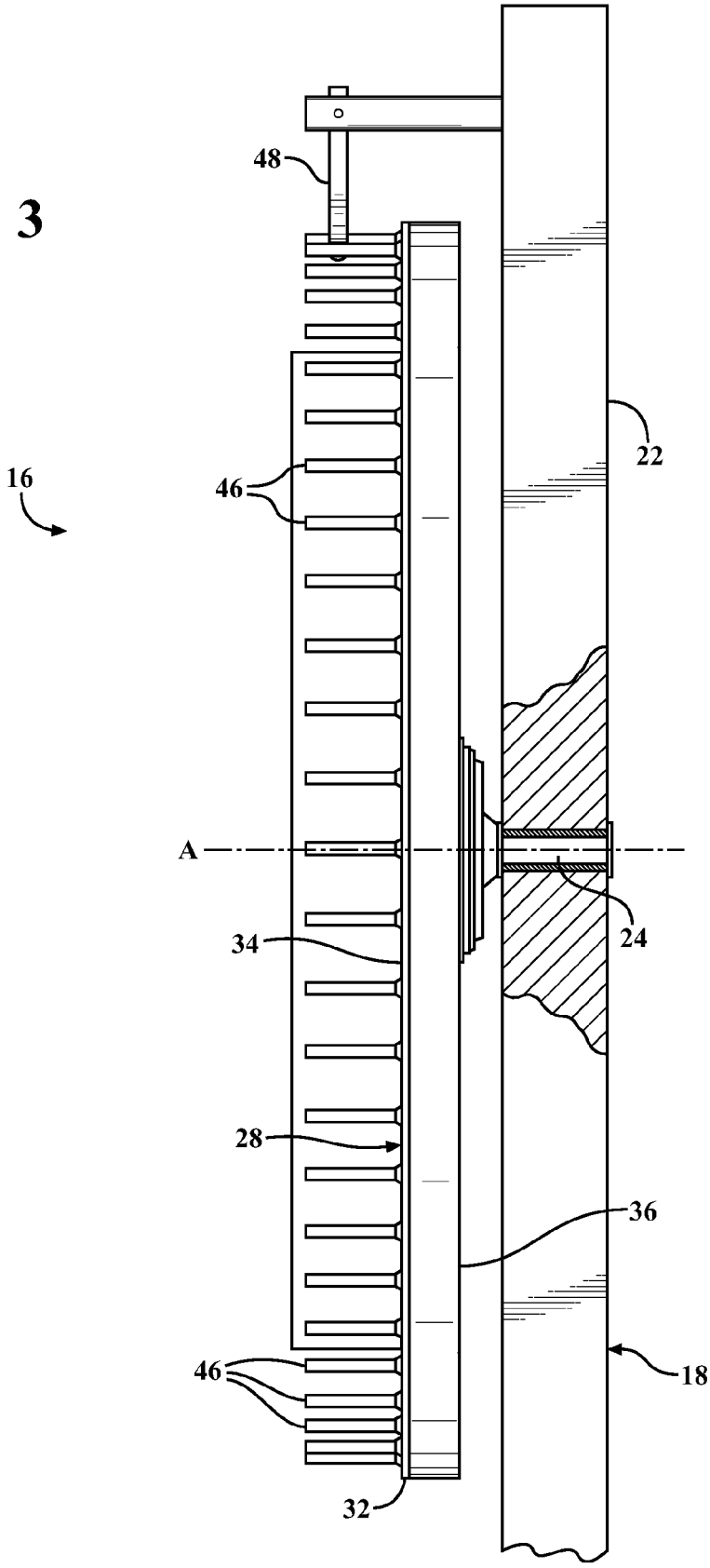
FIG. 3 is a fragmentary side view taken generally along lines 3-3 in FIG. 2 and showing the axle region in cross-section.

A card shuffling and selection machine according to the present invention is generally shown at 16. The card shuffling machine 16 is used in conjunction with a game of chance 10 to randomly generate a game winning decision during each round of play. The card shuffling machine 16 includes a support structure, generally indicated at 18, which is stable and sturdy. The support structure 18 is best shown in FIGS. 1 and 2 including a base 20 for engaging a floor surface. The base 20 may take many forms including separated feet, anchored posts, or a flat, plate-like member as shown here providing stable purchase against the floor. An upright shaft 22 extends generally vertically upwardly from the base 20. Naturally, the upright shaft 22 may take many forms and may even be configured in such a way as to not appear shaft-like in nature. For example, the upright shaft 22 may instead take the form of a cabinet, a framework, a wall, or any other suitable structure anchored sufficiently to the base 20 (or other floor structure) so as to provide sturdy support. The support structure 18 further includes an axle 24 as best shown in FIG. 3. The axle 24 extends generally perpendicularly from the upright shaft 22 for establishing a generally horizontal rotary axis A. In alternative configurations, the axle 24 may be attached directly to a wall surface, cabinet, framework or other type of configuration comprising a support structure 18, all within the contemplated embodiments of this invention. The support structure 18 in this exemplary embodiment includes an optional side arm 26 extending generally perpendicularly from the upright shaft 22 and generally perpendicularly intersecting the rotary axis A. The axle 24 and side arm 26 are, in the illustrated embodiment, vertically aligned with one another. Naturally, in other design expressions of the support structure 18, the side arm 26 may be configured substantially differently or even omitted altogether.

The machine 16 further includes a wheel, generally indicated at 28. The wheel 28 is perhaps best shown in FIGS. 1-3 in its entirety and supported on the axle 24 for free spinning rotation about the horizontal rotary axis A. That is, the wheel 28 includes a journal, socket or other bearing component to receive the axle 24 so that the wheel 28 can be rotated about the rotary axis A without the aid of a motor or power input (other than human muscle power). Naturally, other rotating connection configurations can be envisioned wherein the male portion of the axle 24 is mounted to the wheel 28 directly and a female socket is formed in the support structure 18. Alternatively, respective rotary bearing members may be attached to the support structure 18 and wheel 28 to effect a similar rotating relationship. In any event, the wheel 28 is journaled with low friction bearing elements, grease or other good sliding arrangements so that, when spun manually by an operator, the wheel 28 will freely spin and progressively slow until coming to rest. As shown in FIGS. 1 and 2, the wheel 28 includes a hub section 30 which is enclosed within a generally circular outer rim 32. The hub section 30 has a front face 34 and a back face 36. In use, the front face 34 is disposed toward the game table 12 and toward players of the game of chance 10, whereas the back face 36 is disposed proximate the support structure 18.

The hub section 30 includes a plurality of card slots 38 disposed therein. The total number of the card slots 38 comprises a predetermined number which may vary depending on the type of game played. For example, if the machine 16 is used to play a game similar to or according to the traditional rules of roulette, the predetermined number of card slots 38 may be thirty-seven if playing European style with only one "0". However, the predetermined number may be thirty-eight if playing American style roulette that includes both "0" and "00". If playing a game similar to the game of craps, the predetermined number of card slots 38 may be thirty-six representing the thirty-six possible outcomes of two rolled dice. Naturally, other games may require a different number of predetermined card slots 38. At the time of manufacture, the wheel 28 is formed with the predetermined number of card slots 38. Therefore, a different wheel 28 may be required to play different games of chance. Each card slot 38 extends axially (i.e., relative to the horizontal rotary axis A) from an open end 40 through the front face 34 to a bottom 42. The distance between open end 40 and bottom 42 defines a slot depth X as shown in FIG. 5. The plurality of card slots 38 are disposed in equal circumferential increments about the rotary axis A. Therefore, the arcuate spacing (in degrees) from one card slot 38 to the next adjacent card slot 38 (center-to-center) is generally equal to the number 360 divided by the predetermined number of card slots 38. So, if the predetermined number is thirty-six, the equal circumferential increments between each card slot 38 is 10 degrees. If the predetermined number of card slots is fifty-four, the spacing between card slots 38 (center-to-center) is approximately 6.7 degrees. Likewise for any predetermined number.

Preferably, all of the card slots 38 are disposed generally in a common plane perpendicular to the rotary axis A. In other words, all of the open ends 40 of all of the card slots 38 are disposed in the front face 34 which is contained within a single vertical plane. Furthermore, the card slots 38 are preferably all arranged in generally equal radial spacing from the rotary axis A. This, therefore, gives the appearance of the card slots 38 being arranged in a ring concentric with respect to the rotary axis A as shown in FIGS. 1 and 2. Each card slot 38 is also preferably arranged to extend along a radial passing generally through the rotary axis A. This as well as other construction details can be altered, however, to give aesthetic appeal to the machine 16. In other words, the card slots 38 could be skewed or otherwise angled so as not to lie along an imaginary radial line extending from the central axis A.

Figure 7:
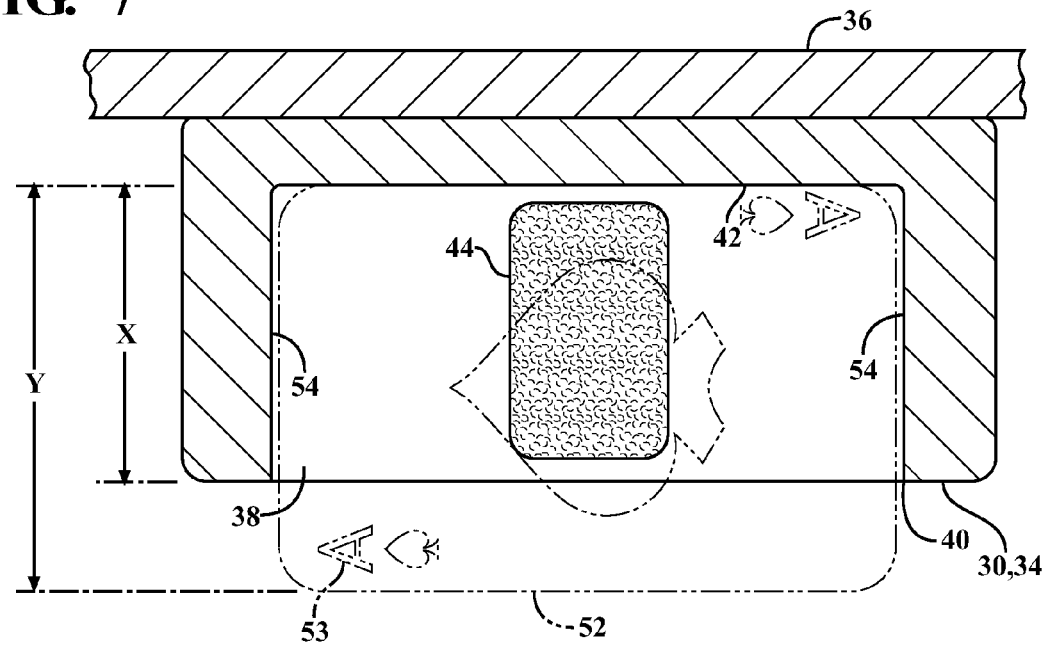
FIG. 7 is a cross-sectional view taken radially through a card slot and generally along lines 7-7 from FIG. 4 with a card disposed therein shown in phantom.
Figure 8:
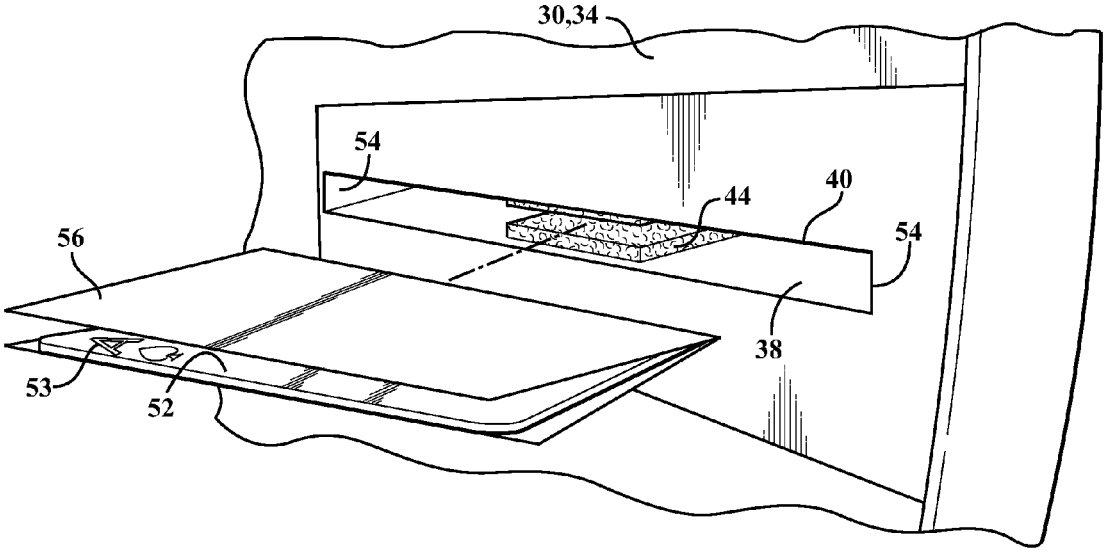
FIG. 8 is a perspective view of a card slot showing a card removed therefrom together with an optional folder used to hide the indicia when the card is placed in the slot.

As perhaps best shown in FIGS. 5, 7 and 8, a friction element 14 is disposed in each of the card slots 38. The friction element comprises, preferably, a pair of opposing textile patches adhered to either circumferential face of the card slot 38, generally midway along its radial length. The textile patches 44 preferably are formed from a material having a deep surface texture formed of piles, loops, strands or other relatively flexible bristles which reach into and may even contact the bristles of the opposing textile patch 44. In one embodiment of the invention, the textile patches 44 may be fabricated from the "loop" half of a Velcro® type hook and loop fastener system. That is, both textile patches 44 are, preferably, made from the same material and therefore both could, in one embodiment, be formed using only the "loop" portion of traditional hook and loop fastener materials. It is important to recognize, however, that other design expressions of a friction element 44 are possible, including one or two spring clips, magnets (assuming an attractive iron mate is incorporated), covers, envelopes, and the like.

The wheel 28 also includes a plurality of dividers 46. The total number of dividers 46 is equal to the predetermined number of card slots 38. Therefore, if the predetermined number of card slots 38 is sixty-two, then there are sixty-two dividers 46. In the illustrated embodiment, each divider 46 extends axially from the front face 34 of the hub 30. The dividers 46 are disposed in equal circumferential increments about the rotary axis A, and are arranged in generally equal radial spacing from the rotary axis A so as to appear in a ring or circular pattern centered about the rotary axis A. In the preferred embodiment, the dividers 46 comprise cylindrical pegs having generally equal axial lengths as perhaps best shown in FIG. 3.

A first flapper 48 is supported by the upright shaft 22 adjacent the outer rim 32 of the wheel 28. As shown in FIGS. 1 and 2, the first flapper 48 may be disposed in a twelve o'clock position by reference to a standard watch face. Relocation of the first flapper 48 to another position, however, is of course possible. The first flapper 48 may comprise a resilient paddle made from rubber, leather, or other spring-like material extending into an interference position relative to the dividers 46 so that when the wheel 28 is spun about the rotary axis A, the dividers 46 will sequentially strike and displace the resilient paddle 48 thereby progressively slowing the spinning wheel 28.

Likewise, a second flapper 50 may be supported by the side arm 26 adjacent the outer rim 32 of the wheel 28. In this condition, and according to the illustrated embodiment, the second flapper 50 is disposed in a three o'clock (or nine o'clock) position relative to the rotary axis A. The second flapper 50 may be formed substantially identical to the first flapper 48 in that a resilient paddle-like element extends into an interference position relative to the dividers 46 to progressively slow the spinning wheel by sequential strikes. Although the machine 16 can be played with only a single flapper, use of two flappers 48, 50 will result in quicker deceleration of the spinning wheel 28 and therefore a quicker game decision. One of the first 48 and second 50 flappers comprises a pointer. This, for example, may be ideally suited to the second flapper 50 which may be located at a height that is more accessible to an average-size human being standing on the floor as shown in FIG. 1. Thus, the second flapper 50 can point to and designate one of the card slots 38, and in particular the most closely proximate card slot 38, after the wheel 28 has come to rest following a manual spin.

Figure 6:
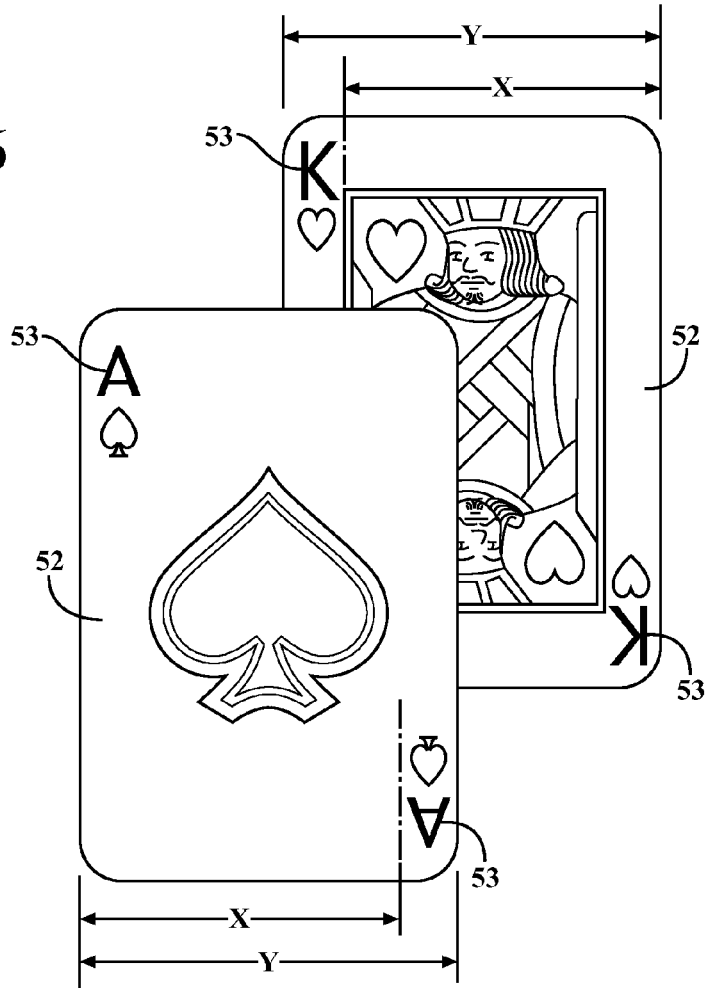
FIG. 6 is a simplified view of two playing cards together with dimensional references correlating dimensions of the playing cards to dimensions of the card slot.

The machine 16 further includes a plurality of cards 52. The cards 52 may be standard playing cards such as used for the games of blackjack and poker, or may be manufactured to custom specifications. The total number of cards 52 is equal to the predetermined number of card slots 38 so that one card 52 is disposed in each card slot 38. For example, if a game similar to craps is being played and the predetermined number of card slots 38 is thirty-six, then thirty-six cards 52 will be provided, each imprinted with indicia 53 representing the thirty-six possible outcomes of two rolled dice. Therefore, whatever game of chance 10 is being played with the machine 16, the cards 52 bear an indicia 53 suitable to decide the outcome of that game of chance 10. Each card 52 has a height and a width Y, wherein the height is greater than the width Y. See, for example, FIG. 6 which illustrates two cards such as found in a standard deck of playing cards bearing indicia 53 "A" (Ace-Spades) and the other card 52 bearing indicia 53 "K" (King-Hearts). The dimension X which, as described above, corresponds to the slot depth X of each card slot 38, is preferably shorter than the card width Y to such a degree that indicia 53 appearing on the side edge of each card 52 can be exposed above the front face 34 of the wheel 28 when a card 52 is disposed in a card slot 38. Thus, the width Y of each card 52 is greater than the slot depth X of each card slot 38.

When a card 52 is disposed in a card slot 38, the extending loops or piles of the friction element 44 are gently displaced so as to hold the card 52 centered and securely in the card slot 38 while the wheel 28 is spun. However, whenever a pointer (e.g., the second flapper 50) comes to indicate a particular card 52 in a card slot 38, the operator can easily remove the card 52 using a light pull stroke with thumb and forefinger. This allows the operator to announce the indicia 53 on the card 52 and thereby decide the game of chance 10 (or at least a portion of the game). Closed ends 54 of each slot 38 positively restrain a card 52 from slipping out the end of a slot 38 when the wheel 28 is spun.

The present invention provides for a casino card or other table game 10 and wherein the card selector 16 is a vertical shuffler rotationally disposed and including at least one, but preferably two flappers 48, 50. Each round of the game 10 includes the step of determining the winning card 52 by spinning the vertical shuffler 16 and allowing the vertical shuffler 16 to come to a rest with the flapper 50 pointing at the winning card 52.

The present invention provides for a unique machine 16 suitable for play of casino games. The present vertical card shuffling machine 16 may, in one exemplary embodiment, include a five foot (5') diameter circular wheel 28 formed with a predetermined number of slots 38 for holding the cards 52 disposed in a circular pattern near the wheel's rim 32. The number of slots 38 depends on the game 10 utilizing the vertical shuffler 16. Thus, a wheel 28 including thirty-six slots 38 is required for traditional craps-type games. A wheel 28 including thirty-eight slots 38 is needed for American style roulette games. And so on. The cards 52 disposed in the slots 38 can be standard playing cards or they could be custom cards having customized indicia 53 or a customized layout.

Figure 9:
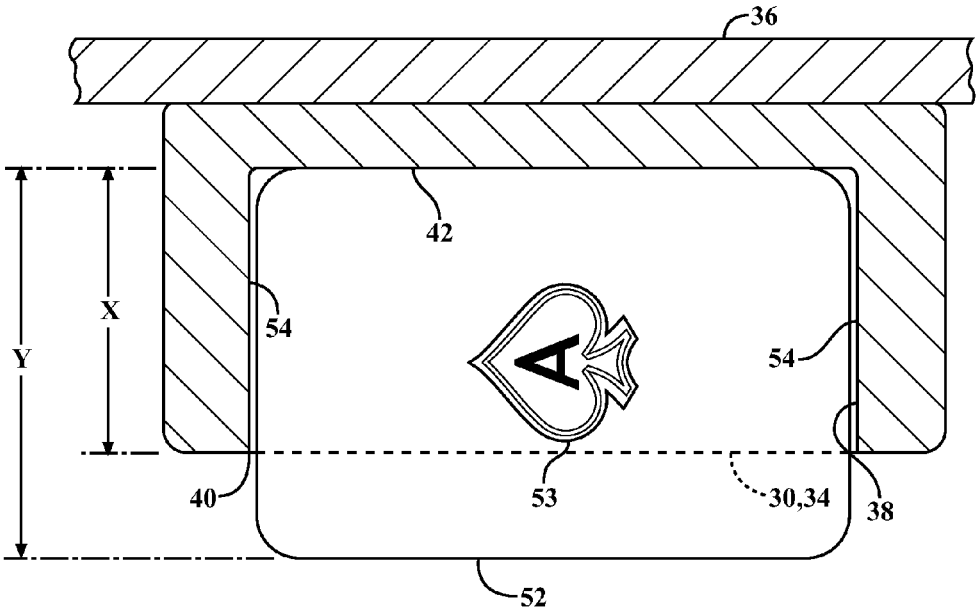
FIG. 9 is a cross-sectional view as in FIG. 7 showing an optional card layout whereby the indicia is arranged so as to be hidden when the card is placed fully in the slot.

It is of utmost importance that the cards 52 do not unintentionally fall out of the slots 38 during the spinning of the vertical shuffler 16. In the preferred embodiment, the slots 38 are made thin and a friction element 44, which may for example take the form of looped textile material like Velcro®, is placed on either side of the slot 38 for holding the cards 52 in position. However, it should be appreciated that other methods could be used to hold the cards 52 in the slots 38, e.g. clips or plastic covers. The cards 52 may also be placed in the slots 38 in their own non-transparent (e.g., manila) folder 56 so that when the card 52 is removed from the shuffler 16, its indicia 53 cannot be seen by the players. This is shown for example in FIG. 8. The folder 58 is especially preferred in games where the players are allowed to continue placing wagers while the wheel is spinning or has come to a stop. The folders 58 may thus be added as an additional confidence factor for the casino. Even without use of the folder 58, in the preferred embodiments only a small portion of the cards 52 can be seen and when the wheel 28 is moving. In this manner, the cards 52 will appear to most players as a blur and almost indiscernible to the naked eye. One of the advantages of using cards 52 is that it gives the casino the option to design custom cards so that none of the indicia 53 are showing when placed in a slot 38. An example of this is shown in FIG. 9. The cards 52 can also be designed with no discernable information on the card whereby RFID or bar coding may be implemented in conjunction with readers calibrated for reading such cards and communicating the results via electronic transfer. Such RFID/coding may be implemented with or without visible indicia 53.

The vertical shuffler machine 16 has a first flapper 48 positioned at the twelve o'clock position to slow the spinning wheel 28 and to provide an interesting clicking noise. Because the circular wheel 28 of the exemplary embodiment is so large, the dealer would have a difficult time reaching and removing the winning card 52 if it was the one at the top of the wheel 28 when it stopped spinning. To solve this problem, the vertical shuffler machine 16 includes a second flapper 50 at the three o'clock position, i.e. within comfortable reach of the dealer even if the dealer is confined to a wheel chair. The second flapper 50 functions to indicate the winning card 52 in addition to making noise and adding increased resistance for slowing the spinning wheel 28. Having two flappers 48, 50 slows the wheel 28 at a much faster rate than many other prize wheel games, thus providing for more rounds per hour of the game to be played. More rounds per hour suggests an increase in potential profit for the casino.

The vertical shuffler 16 is also better than the prize wheels of the prior art systems because it makes collusion between the dealer and the players virtually impossible. In the prior art prize wheel games, dealers are known to rub the wheel with their legs to increase the chances of a desired symbol being the winning symbol. This has been addressed in the exemplary embodiment in two ways: (1) the vertical shuffler has been elevated so that all of the players can see the entire circular wheel 28 above the table 12, and so would see the dealer rubbing the wheel 28 and (2) the cards 52 may be disposed in folders 56 or otherwise hidden so even the dealer cannot see the wining card 52 until the wheel 28 has come to a stop and the card 52 is removed. Alternatively, the cards 52 can be custom manufactured with indicia 53 located toward the card center so that the indicia 53 is hidden when the card 52 is in the slot 38, as shown in FIG. 9.

One significant improvement of the present design relates to game protection. On a prior art prize wheel with fixed indicia, a skilled advantage player can become very proficient in what is referred to in the gaming industry as "wheel tracking". It is a proven fact that the human body exhibits a phenomenon known as muscle memory. Basketball players, tennis player and golfers are just a few professions which rely on muscle memory to replicate a desired outcome. A dealer, when spinning a big wheel is subjected to the same muscle memory science. When a player can see the numbers surrounding the point generation or outcome location, they can determine, with regular accuracy, the section of the apparatus that will come to rest in any given location. Such a player has just shifted the game from having a house advantage to a game having a player advantage which could cost the house a potentially large amount of money if not addressed. With the use of cards 52, the present invention eliminates the fixed indicia and enabled the ability to reposition the cards 52 periodically to assure for random selection as it pertains to any given wager.

In summary, the vertical shuffler 16 of the present invention overcomes the biasing and collusion problems of the prior art vertical prize wheels. In order to increase the attractiveness of the vertical shuffler 16, programmable lights may be also added to the circumference of the front face 34.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A rotary card shuffling and selection machine, said machine comprising:

a support structure, an axel extending generally perpendicularly from support structure for establishing a generally horizontal rotary axis;

a wheel supported on said axel for rotation about said rotary axis, said wheel including a hub section defined within an outer rim, said hub section having a front face, said hub section including a plurality of card slots, the total number of said plurality of card slots comprising a predetermined number, each of said card slots extending axially from an open end through said front face of said hub to a bottom and defining a slot depth, said plurality of card slots disposed in equal circumferential increments about said rotary axis, a friction element disposed in each of said card slots, said wheel including a plurality of dividers, the total number of said plurality of dividers equal to said predetermined number of said card slots, said plurality of dividers disposed in equal circumferential increments about said rotary axis, said plurality of dividers arranged in generally equal radial spacing from said rotary axis;

a first flapper supported by said support structure adjacent said outer rim of said wheel, said first flapper comprising a first resilient paddle extending into an interference position relative to said dividers so that as said wheel is spun about said rotary axis said plurality of dividers sequentially strike and displace said first resilient paddle thereby progressively slowing said spinning wheel to a stop;

a plurality of cards, the total number of said plurality of cards equal to said predetermined number of said card slots, one of said cards removeably disposed in each of said card slots, each said card bearing an indicia suitable to decide the outcome of a game of chance.

2. The machine of claim 1 wherein said friction element comprises a pair of opposing textile patches each having a deep surface texture.

3. The machine of claim 1 wherein each said card has a height and a width, and wherein said height is greater than said width, said width of said cards being greater than said slot depth of said card slots, each said card disposed in each said slot simultaneously displacing said deep surface texture of said respective opposing textile patches in said card slot.

4. The machine of claim 1 wherein each said slot extends along an imaginary radial passing generally through said rotary axis.

5. The machine of claim 1 wherein said plurality of card slots are arranged in generally equal radial spacing from said rotary axis.

6. The machine of claim 1 wherein said plurality of card slots are disposed generally in a common plane perpendicular to said rotary axis.

7. The machine of claim 1 wherein said support structure includes a base for engaging a floor surface.

8. The machine of claim 7 wherein said support structure includes an upright shaft extending generally vertically upwardly from said base.

9. The machine of claim 8 further including a second flapper supported by said support structure adjacent said outer rim of said wheel.

10. The machine of claim 9 wherein said support structure includes a side arm extending generally perpendicularly from said shaft and generally perpendicularly intersecting said rotary axis, said second flapper disposed on said side arm.

11. The machine of claim 10 wherein said second flapper is disposed in a generally 3 o'clock or 9 o'clock position relative to said rotary axis.

12. The machine of claim 9 wherein said second flapper comprises a second resilient paddle extending into an interference position relative to said dividers so that as said wheel is spun about said rotary axis said plurality of dividers will sequentially strike and displace said second resilient paddle thereby progressively slowing said spinning wheel in cooperation with said first flapper.

13. The machine of claim 9 wherein said one of said first and second flappers comprises a pointer.

14. The machine of claim 1 wherein said each of said dividers extending axially from said front face of said hub.

15. The machine of claim 14 wherein said dividers comprising pegs having a generally equal axial length.

16. The machine of claim 1 wherein said hub section having a back face, said back face disposed proximate said support structure.

17. The machine of claim 1 wherein said first flapper is disposed in a generally 12 o'clock position relative to said rotary axis.

18. The machine of claim 1 further including an opaque folder surrounding each said card in said slot.

19. The machine of claim 1 wherein said indicia on each said card is hidden from view when said card is disposed in said slot.

20. A rotary card shuffling and selection machine, said machine comprising:

a support structure, said support structure including a base for engaging a floor surface, said support structure including an upright shaft extending generally vertically upwardly from said base, an axel extending generally perpendicularly from said upright shaft for establishing a generally horizontal rotary axis; a side arm extending generally perpendicularly from said shaft and generally perpendicularly intersecting said rotary axis;

a wheel supported on said axel for free rotation about said horizontal rotary axis, said wheel including a hub section enclosed within a generally circular outer rim, said hub section having a front face and a back face, said back face disposed proximate said support structure, said hub section including a plurality of card slots, the total number of said plurality of card slots comprising a predetermined number, each of said card slots extending axially from an open end through said front face of said hub to a bottom and defining a slot depth, said plurality of card slots disposed in equal circumferential increments about said rotary axis, said equal circumferential increments generally equal in degrees to the number 360 divided by said predetermined number, said plurality of card slots disposed generally in a common plane perpendicular to said rotary axis, said plurality of card slots arranged in generally equal radial spacing from said rotary axis, each said slot extending along a radial passing generally through said rotary axis, a friction element disposed in each of said card slots, said friction element comprising a pair of opposing textile patches each having a deep surface texture, said wheel including a plurality of dividers, the total number of said plurality of dividers equal to said predetermined number of said card slots, each of said dividers extending axially from said front face of said hub, said plurality of dividers disposed in equal circumferential increments about said rotary axis, said plurality of dividers arranged in generally equal radial spacing from said rotary axis, said dividers comprising pegs having a generally equal axial length;

a first flapper supported by said shaft adjacent said outer rim of said wheel, said first flapper disposed in a generally 12 o'clock position relative to said rotary axis, said first flapper comprising a first resilient paddle extending into an interference position relative to said dividers so that as said wheel is spun about said rotary axis said plurality of dividers will sequentially strike and displace said first resilient paddle thereby progressively slowing said spinning wheel;

a second flapper supported by said side arm adjacent said outer rim of said wheel, said second flapper disposed in a generally 3 o'clock or 9 o'clock position relative to said rotary axis, said second flapper comprising a second resilient paddle extending into an interference position relative to said dividers so that as said wheel is spun about said rotary axis said plurality of dividers will sequentially strike and displace said second resilient paddle thereby progressively slowing said spinning wheel;

said second flapper comprising a pointer;

a plurality of cards, the total number of said plurality of cards equal to said predetermined number of said card slots, one of said cards disposed in each of said card slots, each said card bearing an indicia suitable to decide the outcome of a game of chance, each said card having a height and a width wherein said height is greater than said width, said width of said cards being greater than said slot depth of said card slots, each said card disposed in each said slot displacing said respective opposing piled textile patches in said card slot.

* * * * *